US007174600B2

(12) United States Patent
Kresse et al.

(10) Patent No.: US 7,174,600 B2
(45) Date of Patent: Feb. 13, 2007

(54) WIPING SYSTEM WITH WIPING DEVICE AND SQUEEZING OUT DEVICE

(75) Inventors: Franz Kresse, Hilden (DE); Heiko Faubel, Wermelskirchen (DE)

(73) Assignee: Ecolab GmbH & Co. OGH, Dusseldorf (DE)

( * ) Notice: Subject to any disclaimer, the term of this patent is extended or adjusted under 35 U.S.C. 154(b) by 611 days.

(21) Appl. No.: 10/221,921

(22) PCT Filed: Mar. 8, 2001

(86) PCT No.: PCT/EP01/02594

§ 371 (c)(1),
(2), (4) Date: Sep. 16, 2002

(87) PCT Pub. No.: WO01/67942

PCT Pub. Date: Sep. 20, 2001

(65) Prior Publication Data

US 2003/0046782 A1 Mar. 13, 2003

(30) Foreign Application Priority Data

Mar. 17, 2000 (DE) ..... 100 13 044
Apr. 18, 2000 (DE) ..... 100 19 211

(51) Int. Cl.
*A47L 13/20* (2006.01)
*A47L 13/58* (2006.01)
*A47L 13/258* (2006.01)

(52) U.S. Cl. ..... 15/260; 15/264; 15/229.8; 15/229.6; 15/228; 15/144.2; 15/244.2

(58) Field of Classification Search ..... 15/260, 15/261, 119.1, 119.2, 264, 228, 229.8, 229.6, 15/144.2, 244.2
See application file for complete search history.

(56) References Cited

U.S. PATENT DOCUMENTS 2,114,891 A 4/1938 Vaughn (Continued)

FOREIGN PATENT DOCUMENTS

CH 244 556 4/1947

(Continued)

*Primary Examiner*—Gary K. Graham
(74) *Attorney, Agent, or Firm*—Merchant & Gould P.C.

(57) ABSTRACT

The invention relates to a wiping device, a squeezing out device and a container device enabling a textile wiping element located on a wiping panel of the wiping device to be squeezed out simply and reliably. The wiping panel is provided with edge fixing sections which can be held from behind by a counter bearing device of the squeezing out device in order to prevent the wiping panel from being moved out of the squeezing out device unintentionally when the textile element is squeezed out on a bearing surface, or which have an insertion ramp which facilitates the optionally jamming insertion between the bearing surface and a counter bearing surface that is set apart from said bearing surface.

16 Claims, 11 Drawing Sheets

U.S. PATENT DOCUMENTS

| | | | | | |
|---|---|---|---|---|---|
| 2,163,638 | A | * | 6/1939 | Vaughn | 15/244.1 |
| 2,577,496 | A | | 12/1951 | Wolfer | |
| 2,596,749 | A | * | 5/1952 | Webber | 211/70.6 |
| 2,731,658 | A | * | 1/1956 | Miller | 15/244.1 |
| 3,299,458 | A | | 1/1967 | Royalty | |
| 3,562,841 | A | | 2/1971 | Royalty | |
| 3,692,369 | A | * | 9/1972 | Chase | 403/161 |
| 3,760,450 | A | * | 9/1973 | Griffin et al. | 15/229.6 |
| 3,991,431 | A | * | 11/1976 | Thielen | 15/147.2 |
| 4,165,550 | A | * | 8/1979 | Burke | 15/144.2 |
| 4,885,876 | A | * | 12/1989 | Henke | 451/503 |
| 4,961,242 | A | * | 10/1990 | Kresse et al. | 15/228 |
| 5,315,734 | A | * | 5/1994 | Kresse et al. | 15/229.4 |
| 5,426,809 | A | * | 6/1995 | Muta | 15/228 |
| 2003/0126710 | A1 | * | 7/2003 | Policicchio et al. | 15/228 |

FOREIGN PATENT DOCUMENTS

| | | | |
|---|---|---|---|
| DE | 35 05 973 | | 8/1986 |
| DE | 93 07 792.0 | | 4/1993 |
| DE | 197 07 613 | | 5/1998 |
| EP | 0 122 675 | | 10/1984 |
| EP | 0 713 671 | | 5/1996 |
| FR | 1 356 255 | | 11/1962 |
| GB | 330 543 | | 6/1930 |
| WO | 95/00062 | * | 1/1995 |
| WO | WO 98/06316 | | 2/1998 |

* cited by examiner

WIPING SYSTEM WITH WIPING DEVICE AND SQUEEZING OUT DEVICE

FIELD OF THE INVENTION

The present invention relates to a wiping device, a squeezing-out device, a container device, a wiping system and use of a squeezing-out device for squeezing-out a wiping element or textile of a wiping device.

BACKGROUND OF THE INVENTION

Inter alia a wiping device with a wiping panel which carries a wiping element or textile on its underside may be used for cleaning or wiping a floor or the like. The wiping textile is usually rinsed relatively frequently from time to time in water, a washing or cleaning fluid, a cleaning liquor or the like. It is then necessary to squeeze out the washing textile each time in order to expel excess liquid absorbed by the washing textile and to obtain the residual moisture desired for the respective use.

The present invention relates to a wiping device in which the wiping panel holding the wiping element or textile is hinged to a handle. In particular, a universal joint is provided between the handle and the wiping panel. A wiping device of this type is highly manageable and has been successfully tried and tested. However, it is difficult to squeeze out the wiping textile because, owing to the hinged connection to the handle, the wiping panel may move aside in an undesirable manner. A wiping device in which the wiping panel is hinged to the handle and which is also known as a hinged wiping device will be described hereinafter.

A squeezing-out device for a hinged wiping device is known from WO 98/06316 A1 which forms the starting point of the present invention. The squeezing-out device is arranged on an associated container and comprises an obliquely positioned support face which is provided with perforations. A counter-support device is arranged at a distance above the support face so the wiping panel may be inserted obliquely downwards between the support face and the counter-support device by a longitudinal edge when the handle is folded down. When the handle is then raised, the handle rests on the counter-support device and acts as a two-arm lever in such a way that the underside of the wiping panel presses against the support face and the wiping textile is accordingly squeezed out. The drawback is that only relatively low squeezing-out forces may be applied with the known arrangement owing to undesirable lever ratios and the threat of the container tipping over. A further drawback is that the wiping device can slide out of the squeezing-out device during the squeezing-out process. This is promoted, in particular, by a corresponding force component which is directed against the insertion direction which the handle exerts on the wiping panel during the squeezing-out process.

FR 1 356 255 A discloses a similar squeezing-out device for a rigid wiping device. In this patent, the support face is formed by a tiltably mounted support plate which distributes the pressure as uniformly as possible over the wiping element or textile to be squeezed out.

U.S. Pat. No. 3,562,841 discloses a squeezing-out device for a wiping device in which a handle is rigidly attached to a wiping panel carrying a wiping element. In the region of the wiping panel, the handle comprises a holding portion which projects upwardly and is adapted to engage in the manner of a hinge behind a projecting securing portion of a counter-support device of the squeezing-out device. The counter-support device is arranged in an upper end region of a support face of the squeezing-out device so the wiping device or its wiping panel can be inserted between the counter-support device and the support face by the holding portion by an upwardly directed movement. The wiping element can then be squeezed out on the support face by pivoting the handle. However, this squeezing-out device is not suitable for a hinged wiping device.

U.S. Pat. No. 3,299,458 A discloses a solution similar to the aforementioned wiping device and squeezing-out device.

EP 0 122 675 B1 discloses a hinged wiping device and an associated squeezing-out device. The squeezing-out device comprises a curved, elastically deformable support face and counter-support elements arranged at a distance therefrom. The wiping device comprises counter-elements which may be engaged with the counter-support elements in such a way that the wiping panel with a wiping textile arranged thereon may be pressed against the support face by pivoting a handle of the wiping device about a pivot axis extending parallel to the longitudinal direction of a wiping panel of the wiping device. According to a first variation, the counter-elements are constructed as separate levers which are coupled to a cardan shaft and may be pivoted toward the counter-support elements by pivoting the actual handle from the wiping panel. According to a second variation, a hinge element which may be pivoted by the handle and is mounted on the wiping panel comprises the lateral projections which form counter-elements and may rest on the counter-support elements. The construction of the squeezing-out device is relatively complex in both cases. The wiping device or the wiping panel thereof cannot be prevented from sliding out of the squeezing-out device during the squeezing-out process. In addition, the squeezing-out process necessitates relatively precise handling of the wiping device, with the risk that the counter-elements will slide relatively easily on the counter-support elements.

GB 330,543 A discloses a similar hinged wiping device. A lever acting as counter-element for resting on a counter-support element of an associated squeezing-out device is coupled to a handle of the wiping device.

DE 197 07 613 C1 discloses a wiping device with a handle. A wiping head with a wiping element is rigidly fixed to the rigid handle. In particular, the wiping element is arranged on a convexly curved underside of the wiping head. The handle is curved in the region of the wiping head in such a way that its end can engage below a counter-support device of an adapted squeezing-out device. The wiping element can then be squeezed out on a support face adapted to its curvature by pivoting the handle.

SUMMARY OF THE INVENTION

It is the object of the present invention to provide a hinged wiping device, a squeezing-out device and a container device for a wiping device of this type and a wiping system and a use of a squeezing-out device for a wiping device of this type to allow reliable squeezing-out of a wiping element or textile of the wiping device as well as ease of construction and handling.

A basic idea of the present invention is to secure a wiping panel of a hinged wiping device in an interlocking manner against undesirable movement out of the squeezing-out device when squeezing-out a wiping element or textile held by the wiping panel in a squeezing-out device.

In particular, the wiping panel has, on its upper side, a projecting holding portion in an edge region—preferably along a longitudinal edge or along both longitudinal edges—of the wiping panel, the holding portion having an internal, in other words on the side remote from the outer edge of the wiping panel, an undercut with an extension component extending perpendicularly to the upper side or main extension plane of the wiping panel. This configuration allows a counter-support device with a projecting securing portion to engage behind the holding portion or the undercut thereof when the wiping panel is inserted into a squeezing-out device provided with the counter-support device for squeezing-out the wiping element or textile. The wiping panel can then be pressed against a support face of the squeezing-out device by corresponding pivoting of a handle of the wiping device, the interlocking engagement of the holding portion or the undercut by the securing portion preventing the wiping panel from moving or slipping out of the squeezing-out device in an undesirable manner.

A further idea of the present invention is to provide the wiping panel and, in particular, the holding portions thereof with an insertion ramp which is inclined in the insertion direction so the wiping panel with a wiping element or wiping textile can be inserted—optionally in a jamming manner—between the support face and an opposing support face spaced therefrom with simple handling and minimal force for the subsequent squeezing-out of the wiping element or textile on the support face. Unintentional movement out of the squeezing-out device is in turn at least substantially avoided while allowing simple handling.

According to a further aspect of the present invention, the support face is inclined to the horizontal and the opposing support device is arranged above the support face in a lower region of the support face. This allows simple insertion of the wiping panel into the squeezing-out device with a downwardly directed movement.

BRIEF DESCRIPTION OF THE DRAWINGS

Further details, features, aspects and advantages of the present invention will be described in more detail hereinafter with reference to drawings of preferred embodiments, in which.

DETAILED DESCRIPTION OF THE INVENTION

FIGS. 1 to 10 show a first preferred embodiment.

Figure 1:
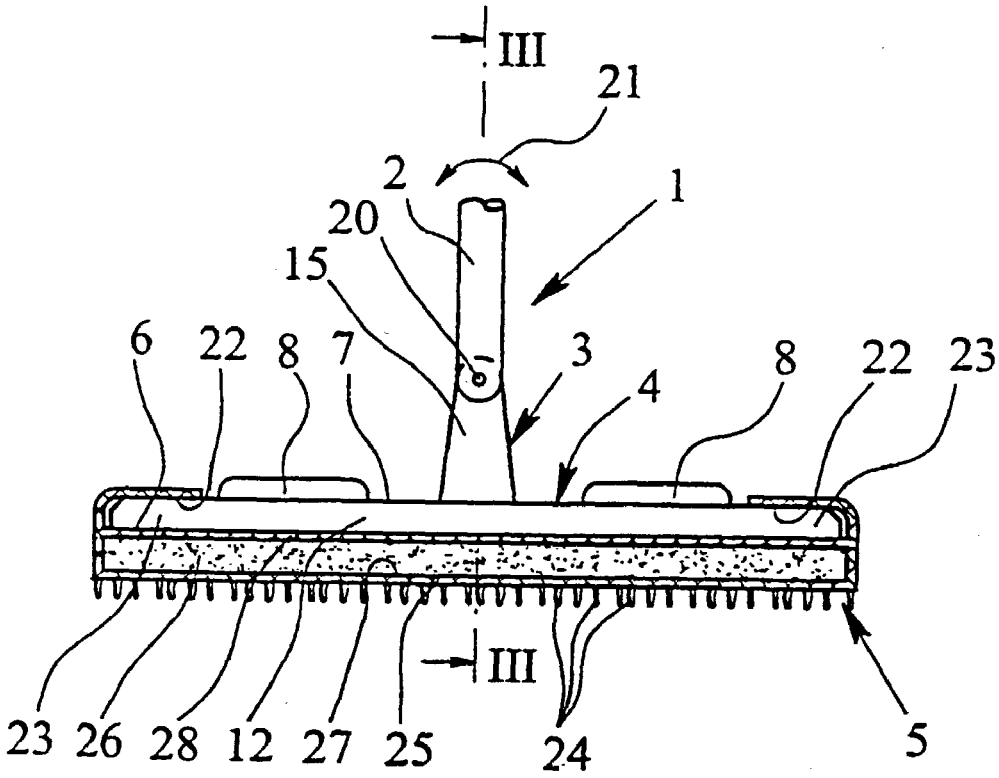
FIG. 1 is a schematic side view of a proposed wiping device with a wiping textile arranged thereon and shown in section.

FIG. 1 shows a proposed wiping device 1 comprising a handle 2 and a wiping panel 4 attached to the handle 2 by a hinge 3. Therefore, the wiping panel 4 is attached to the handle 2 by a hinge or may be attached to the handle 2 in the case of a removable hinge 3.

The wiping panel 4 secures a wiping element or textile 5, as indicated schematically in FIG. 1. This may be, for example, a sponge-like wiping element 5 made of porous material or the like. The wiping element 5 preferably consists at least substantially of textile material in the broadest sense so only the wiping textile 5 is mentioned hereinafter in this connection.

The wiping textile 5 is or may be or at least substantially arranged on a plane underside 6 of the wiping panel 4. The wiping textile 5 may be rigidly fixed to the wiping panel 4. Preferably, the wiping textile 5 is releasably connectable to the wiping panel 4, as in the embodiment illustrated. This will be dealt with in more detail in the description of a preferred construction of the wiping textile 5.

The underside 6 of the wiping panel 4 preferably has an at least substantially plane, continuous construction, in other words without interruptions. This is beneficial for the uniform squeezing-out of the wiping textile 5.

Figure 3:
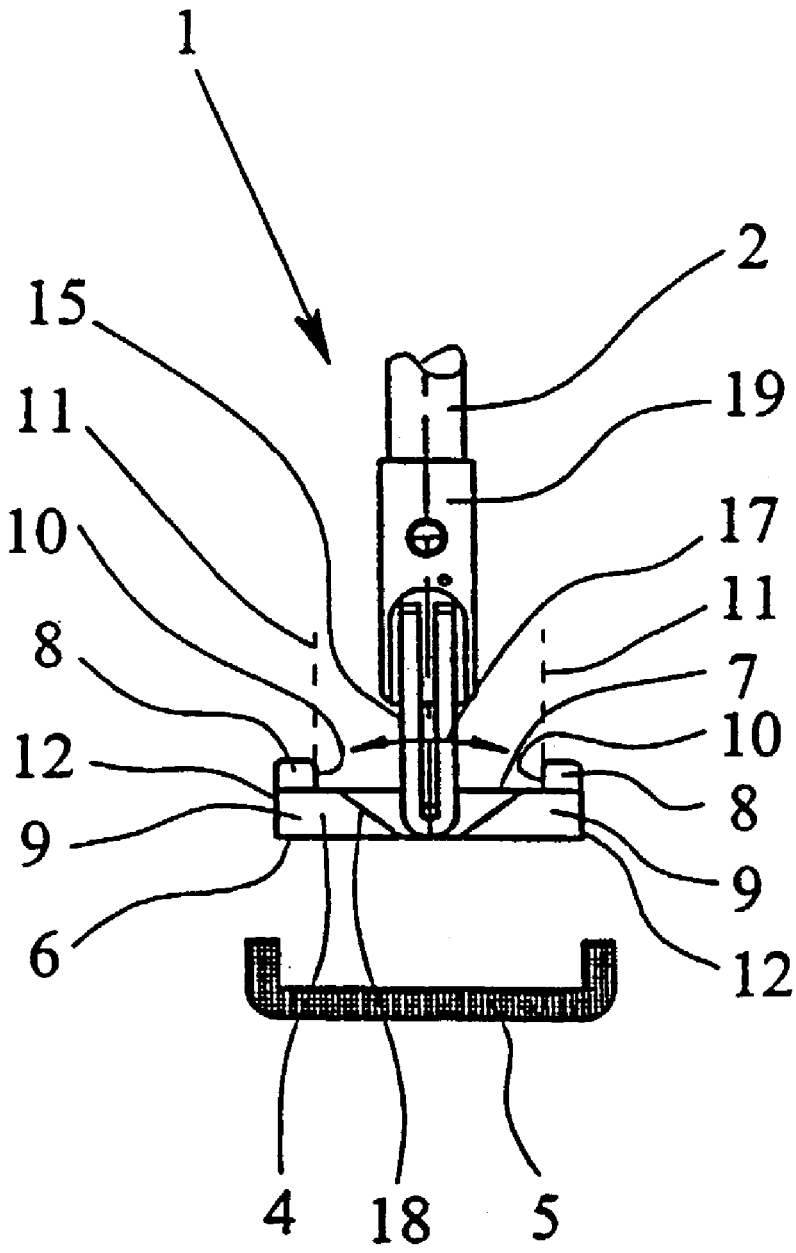
FIG. 3 is a section of the wiping device according to FIG. 1 along line III—III with the wiping textile released.

FIGS. 1 and 3 show that the wiping panel 4 comprises, on its upper side 7 remote from the underside 6, at least one holding portion 8, and a plurality of holding portions in this case, in edge regions 9 of the wiping panel 4. Each holding portions 8 has, on its interior, in other words on its side remote from the outer edge of the wiping panel 4, an undercut 10 comprising an extension component 11 extending perpendicularly to the upper side 7 of the wiping panel 4 or to the main extension plane of the wiping panel 4. The holding portions 8 therefore protrude from the wiping panel 4 in such a way that they can engage behind the undercuts 10.

The undercuts 10 can obviously extend at an inclination to the upper side 7 but preferably form at least substantially a right angle with the adjoining upper side 7 of the wiping panel 4.

According to the illustrated preferred embodiment, the holding portions 8 are arranged adjacent and parallel to longitudinal edges 12 of the wiping panel 4. In particular, two respective holding portions 8 are arranged along a longitudinal edge 12 of the wiping panel 4 and symmetrically to the hinge 3 or to the transverse axis 13, as indicated in the plan view in FIG. 4.

Figure 4:
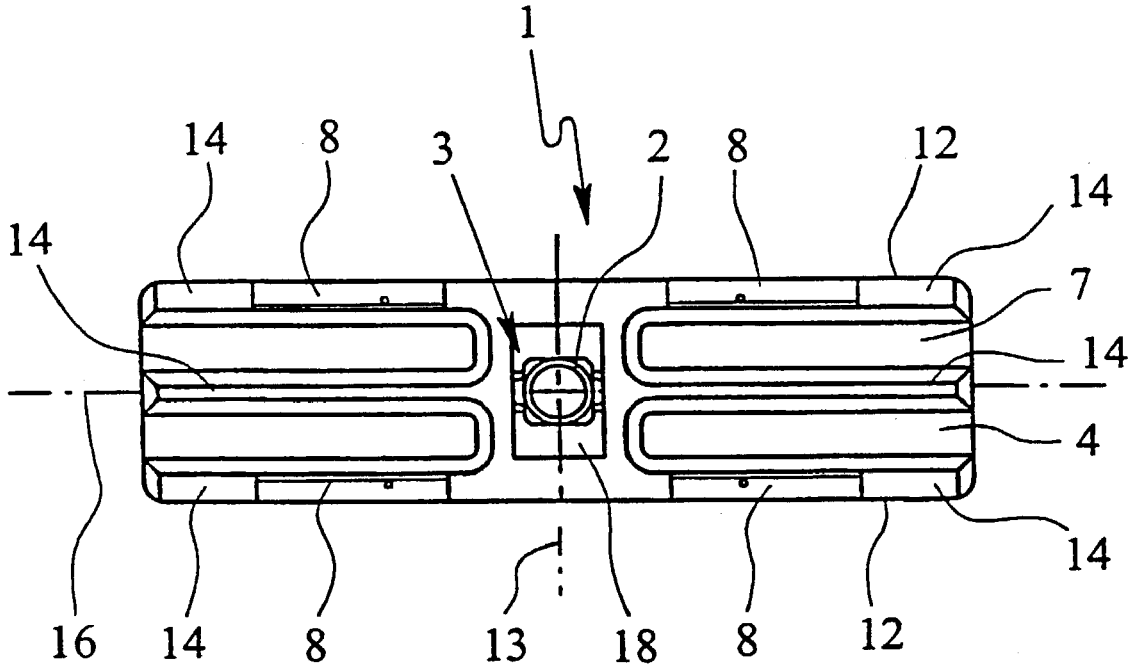
FIG. 4 is a plan view of the wiping device according to FIG. 1 without wiping textile.

The plan view in FIG. 4 without a wiping textile 5 also shows that the wiping panel 4 has reinforcing ribs 14 on its upper side 7, which also extend in the longitudinal direction, in other words substantially parallel to the longitudinal edges 12 of the wiping panel 4 in the example illustrated. Alternatively or additionally, differently shaped reinforcing elements can obviously also be provided on the upper side 7 of the wiping panel 4. The reinforcing ribs 14 and other reinforcing elements may also be dispensed with, depending on the strength of the material used for the wiping panel 4.

In the example illustrated, the holding portions 8 are arranged or formed on marginal reinforcing ribs 14. This is only one embodiment. For example, the holding portions 8 may also be arranged on an upper side 7 of the wiping panel 4 which is smooth at least in the edge regions 9. Similarly, the holding portions 8 may also be formed by suitable portions of the marginal reinforcing ribs 14.

The wiping panel 4 is preferably produced from plastics material and constructed in one piece. Therefore, the holding portions 8 are preferably formed integrally on the holding panel 4.

The hinge 3 joining the handle 2 to the wiping panel 4 is preferably designed as a universal joint, as already mentioned, and, in the example illustrated, comprises a hinge element 15 which, on the one hand, is mounted pivotally about a longitudinal axis 16 indicated in FIG. 4 on the wiping panel 4 so the hinge element 15 is pivotal together with the adjoining handle in the direction of the double arrow 17 in FIG. 3 until the hinge element 15 strikes the wiping panel 4 in the region of the recess 18 which is V-shaped in this case. On the other hand, the hinge part 15 is joined to the handle 2 by a preferably tubular connecting element 19, as indicated in FIG. 3, the connecting element 19 and the hinge element 15 being pivotal relative to one another about the pivot axis 20 indicated in FIG. 1 and extending at least substantially parallel to the transverse axis 13, in the direction of the double arrow 21. This is merely a preferred design of the hinge 3. Other design solutions are obviously also possible here.

Figure 2:
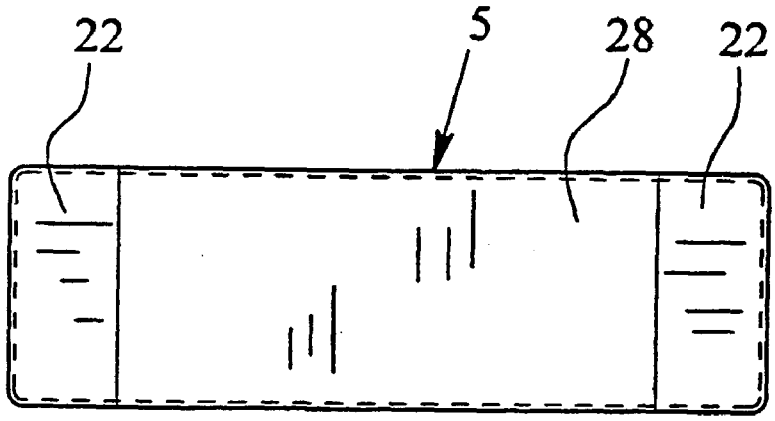
FIG. 2 is a plan view of the wiping textile according to FIG. 1.

A preferred embodiment of the wiping textile 5 will be described in more detail hereinafter with reference to FIGS. 1 and 2. The wiping textile 5 is substantially flat in construction with a shape adapted to the flat shape of the wiping panel 4, which is substantially rectangular in this embodiment. On its upper side, the wiping textile 5 comprises two push-in pockets 22, which are formed, in particular, by sewing on or sewing up corresponding portions of material and are open toward the centre, in the region of its transverse sides. End regions 23 of the wiping panel 4 may be inserted into these push-in pockets 22, the wiping textile 5 having adequate elasticity here owing to the rigid design of the wiping panel 4. Alternatively, the wiping textile 5 may also be attached to the wiping panel 4 by means of other fastening means such as burr-type fasteners or rigidly.

On its underside, the wiping textile 5 comprises wiping portions 24 which are constructed, for example, in the form of fringes, loops, tufts or blades and are produced, for example from plastics material, in particular polyester, of microfibres, of cotton or of a mixture of these materials. The wiping portions 24 are held by an adjoining carrier fabric 25 of which the area corresponds to the area of the wiping textile 5. An absorbent material 26 is arranged on the side of the carrier fabric 25 remote from the wiping portions 24, preferably in a pocket 27 formed by the wiping textile 5. The absorbent material 26 is highly absorbent, in other words it can absorb a multiple of its inherent weight of liquid, in particular an aqueous liquid such as a cleaning liquor or the like. The absorbent material 26 is preferably constructed from a plurality of pieces, for example in the form of chips, cuttings or the like. However, the absorbent material 26 may also form a continuous layer or the like, in other words may be constructed in one piece. The pocket 27 is closed at the side remote from the carrier fabric 25 by a covering layer 28 which is sewn to the carrier fabric 25 along its edge. In particular, the covering layer 28 is produced from the same material as the carrier fabric 25.

The carrier fabric 25 and the washing portions 24 do not have to have absorbency or optimum absorbency. Rather, the materials used for this purpose may be optimally adapted to desired cleaning properties, sliding properties, desired rigidity, flexibility and durability. It is important that the carrier fabric 25 is permeable to liquids, in particular ensures a good exchange of liquid with the absorbent material 26, for example due to capillary action or corresponding openings, meshes, or the like. The absorbent material 26 has optimum absorbency. Materials with a high viscose content are particularly suitable for this purpose. The absorbent material 26 is selected, in particular, in such a way that it releases liquid which is taken up or absorbed relatively easily under pressure.

Figure 5:
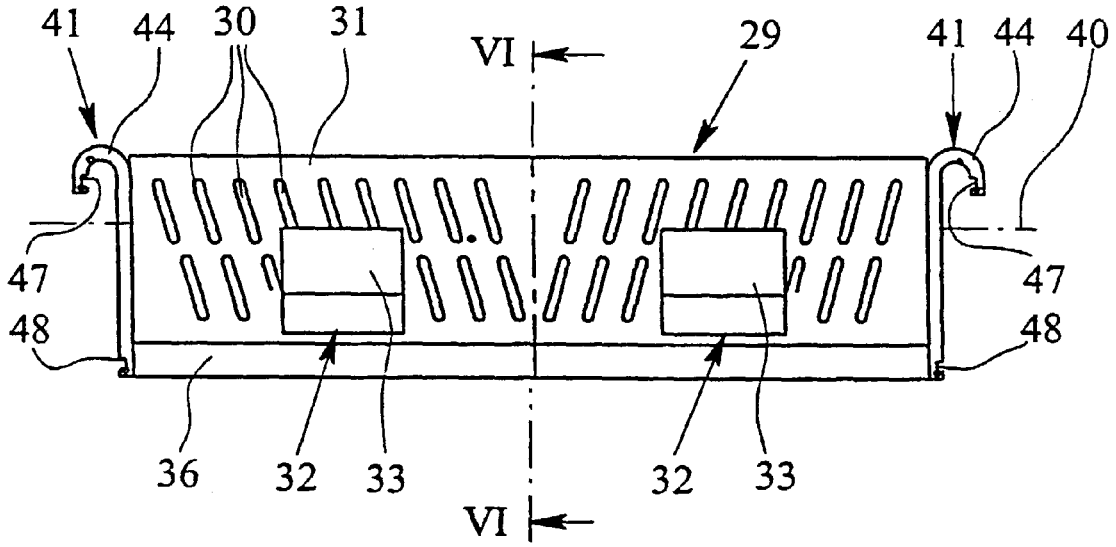
FIG. 5 is a side view of a proposed squeezing-out device.

FIG. 5 is a side view of a proposed squeezing-out device 29. The squeezing-out device 29 comprises a support face 31 which is provided with perforations 30, is formed by a corresponding panel piece, moulding, or the like and on which the wiping textile 5 may be squeezed out by pressing on the wiping panel 4, further details of which will be given hereinafter.

The squeezing-out device 29 also comprises a counter-support device 32 which is formed by two counter-support elements 33 in this embodiment.

Figure 6A:
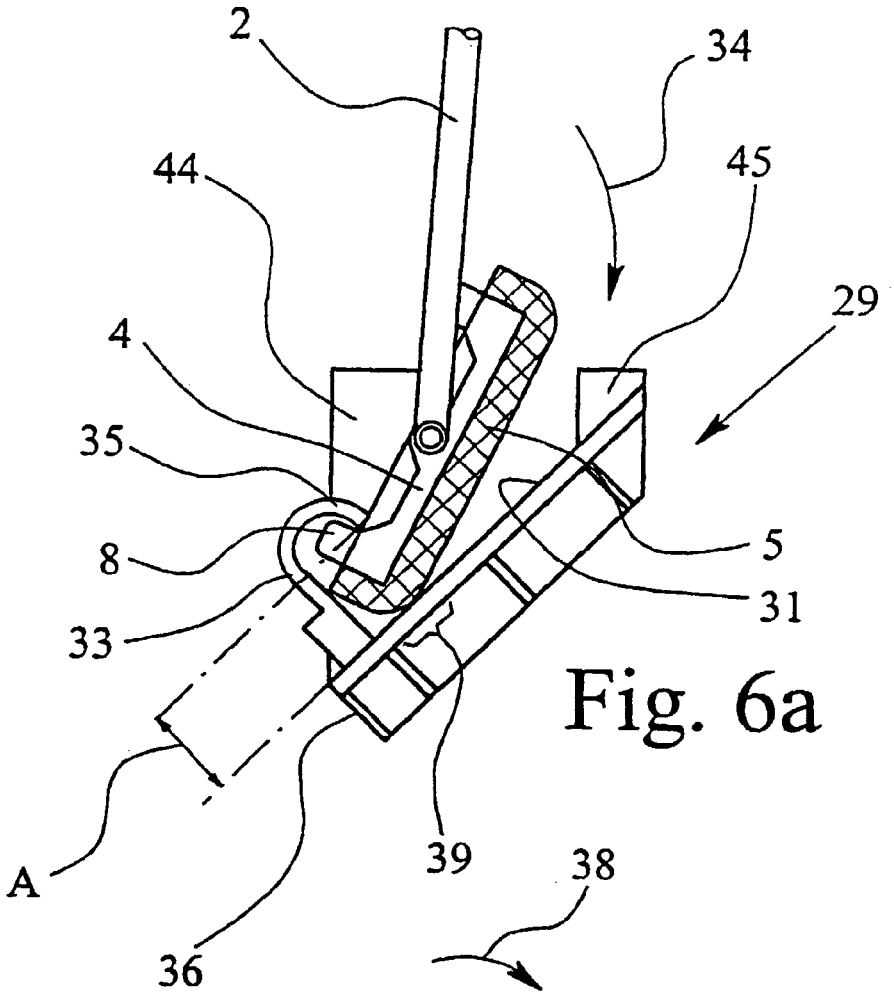
FIGS. 6*a, b* are schematic sections of the squeezing-out device according to FIG. 5 along line VI—VI (a) during insertion of a wiping panel and (b) with inserted wiping panel during the squeezing-out process.
Figure 6B:
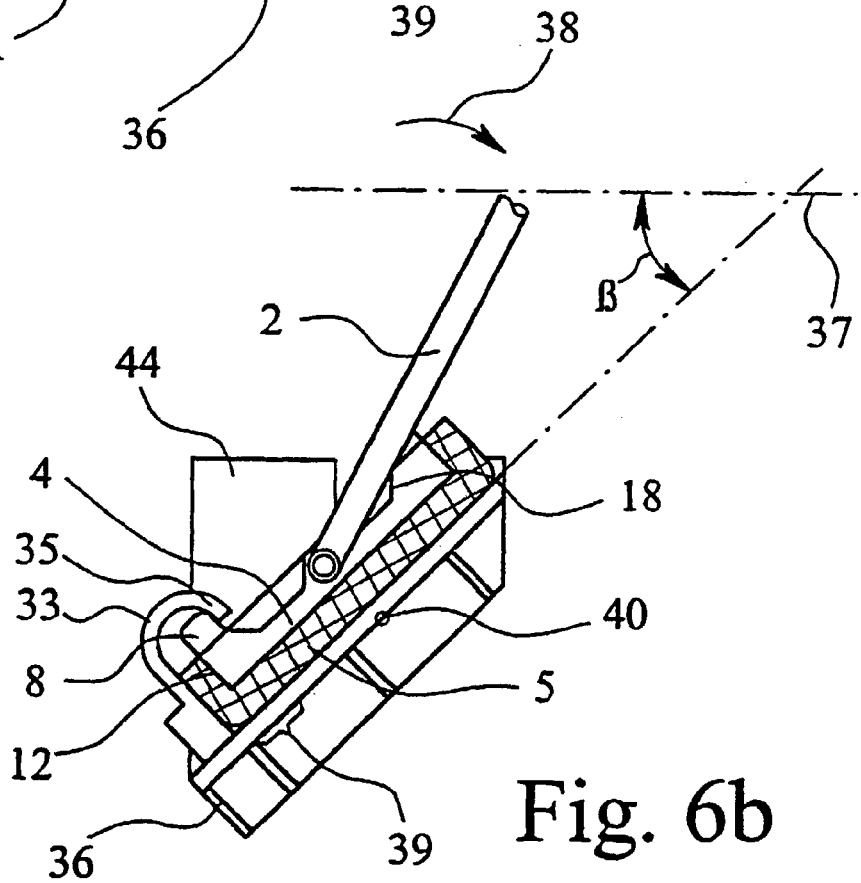

FIGS. 6*a* and 6*b* show the proposed squeezing-out device 29 in a schematic side view along line VI—VI in FIG. 5, in FIG. 6*a* when inserting the wiping panel 4 and FIG. 6*b* when squeezing-out the wiping textile 5. FIG. 6*a* illustrates the insertion movement 34 with which the wiping device 1 or its wiping panel 4 is inserted into the squeezing-out device 29 between the support face 31 and the counter-support device 32 or the counter-support element 33 thereof by a longitudinal edge 12. The holding portions 8 associated with or adjacent to the inserted longitudinal edge 12 are thus engaged with the counter-support device 32 or the counter-support elements 33 thereof or engagement thereof is permitted so securing portions 35 of the counter-support device 32 or the counter-support elements 33 protruding or projecting toward the support face 31 engage or are able to engage behind the inserted holding portions 8 or the undercuts 10 thereof.

The extent to which the insertion movement 34 has to include a pivoting or tilting of the wiping panel 4 about its longitudinal axis 16 depends on the clearance A between the securing portions 35 and the support face 31 relative to the overall height of the wiping panel with the wiping textile 5 and the holding portions 8 projecting to the greatest extent on the upper side 7. Preferably, pivoting-in is necessary, as indicated in FIG. 6*a*, so the wiping panel 4 is secured in an interlocking manner against moving from the squeezing-out device 29 when the wiping panel 4 with the wiping textile 5 rests flat on the support face 31 as shown in FIG. 6*b*.

The construction of the counter-support device 32 will be described in more detail hereinafter with reference to a counter-support element 33. FIGS. 6*a* and *b* show that the counter-support element 33 is arranged in the region of a lower longitudinal edge 36 of the support face 31 on the squeezing-out device 29. For example, each counter-support element 33 is screwed onto the squeezing-out device 29 or onto the support face 31. However, the counter-support element 33 may also be formed, for example, integrally on the squeezing-out device 29.

The counter-support element 33 has a hook-like construction in this embodiment and ends at is free end in the securing portion 35 which preferably projects at least substantially perpendicularly to the support face 31.

Instead of two or more counter-support elements 33, for example, a continuous rail or the like may also be arranged or constructed as counter-support device 32 on the squeezing-out device 29.

FIGS. 6*a* and 6*b* also show that the squeezing-out device 29 shown in the service position is constructed in such a way that the support face 31 is inclined at an angle β to the horizontal 37. The angle of inclination is preferably between 30° and 60°, in particular about 45°. Simple insertion and squeezing-out of the wiping device 1 is therefore achieved in combination with the counter-support device 32 arranged in the lower region—in the region of the lower longitudinal edge 36 in this case.

FIG. 6*b* illustrates the squeezing-out process. Once the wiping panel 4 has been inserted, the handle 2 is folded or pivoted about the longitudinal axis 16 away from the counter-support device 32 in the direction of the arrow 38. The handle 2 or a part of the hinge 3 comes to rest on the wiping panel 4—for example in the region of the V-shaped recess 18 in this case—, so further pressing on the handle 2 in the direction of the arrows 38 causes the wiping panel 4 to be pressed with its underside 6 down toward the support face 31 so the wiping textile 5 is squeezed out. The counter-support device 32 or its securing portions 35 cooperate with the inserted holding portions 8 of the wiping panel 4, in particular in the manner of a hinge, so the counter-support device 32 forms, so to speak, the pivot point for a one-arm lever formed by the wiping panel 4 and the adjoining handle. This one-arm lever enables the wiping textile 5 to be squeezed out easily on the hinged wiping device 1.

To allow the wiping textile 5 to be squeezed out as uniformly as possible over its entire expanse, it is important for the wiping panel 4 also to be at the smallest possible distance from the support face 31 even in the region of the counter-support device 32 during the squeezing-out process. In particular, it is desirable that the underside 6 of the wiping panel 4, at the end of the squeezing-out process, has at least substantially uniform spacing—in other words an at least substantially parallel orientation to the plane support face 31 in this case, if the wiping textile 5 has an at least substantially uniform thickness—an in particular uniform distribution of the absorbent material 26 in the pocket 27 in this case.

To achieve a squeezing-out process which is as uniform as possible, the counter-support device 32 with its securing portions 35 resting, for example, on the upper side 7 of the wiping panel 4 and/or with other regions of the counter-support elements 33 acting, for example, on the upper side of the holding portions 8 accordingly acts on the wiping panel 4 in such a way that the wiping panel 4 is at a desired, in particular relatively small, distance from the support face 31 in the region of its inserted longitudinal axis 15 in the inserted state. The counter-support device 32 and the wiping panel 4 can accordingly be adapted to one another in such a way that, on insertion of the wiping panel 4 with the insertion movement 34, a certain degree of pressing on and squeezing-out of the wiping textile 5 takes place in the region 39 of the support face 31 remote from the counter-support device 32. For example, the distance A between the securing portions 35 and the support face 31 is selected so as to be correspondingly small. However, a pressure can also be applied to the free end of the holding portions 8 by the counter-support elements 33 when the wiping panel 4 is introduced. It is sufficient in the last case if the securing portions 35 merely serve to secure the wiping panel 4 in the squeezing-out device 29 in an interlocking manner.

To even out the squeezing-out of the wiping textile 5, it is alternatively or additionally proposed that the distance between the counter-support device 32 and the support face 31 be variable in the opposing region 39 and be reducible during the squeezing-out process in order to hold the wiping panel 4 down on the support face 31, in particular in the region of its inserted longitudinal edge 15. For this purpose, the counter-support device 32 is correspondingly adjustable in construction or arranged, for example, separately from the support face 31, the support face 31 being mounted so as to tilt or pivot, for example about an axis indicated in FIG. 5, so the region 39 of the support face 31 remote from the counter-support device 32 is moved toward the counter-support device 32 during the squeezing-out process. In particular, the tilt axis 40 is arranged substantially adjacent to the longitudinal axis 16 of the wiping panel 4 when the wiping panel 4 is inserted, to produce a uniform pressure distribution between the underside 6 and the support face 31 during the squeezing-out process by pressing down the handle 2, as indicated in FIG. 6*b*.

In addition, uniform squeezing-out of the wiping textile 5 may be assisted by relatively free or relatively high mobility or deformability of the absorbent material 26 in the pocket 27 of the wiping textile 5, so the absorbent material 26 is distributed according to the pressure conditions and uniform or more uniform squeezing-out is thus achieved.

Figure 8:
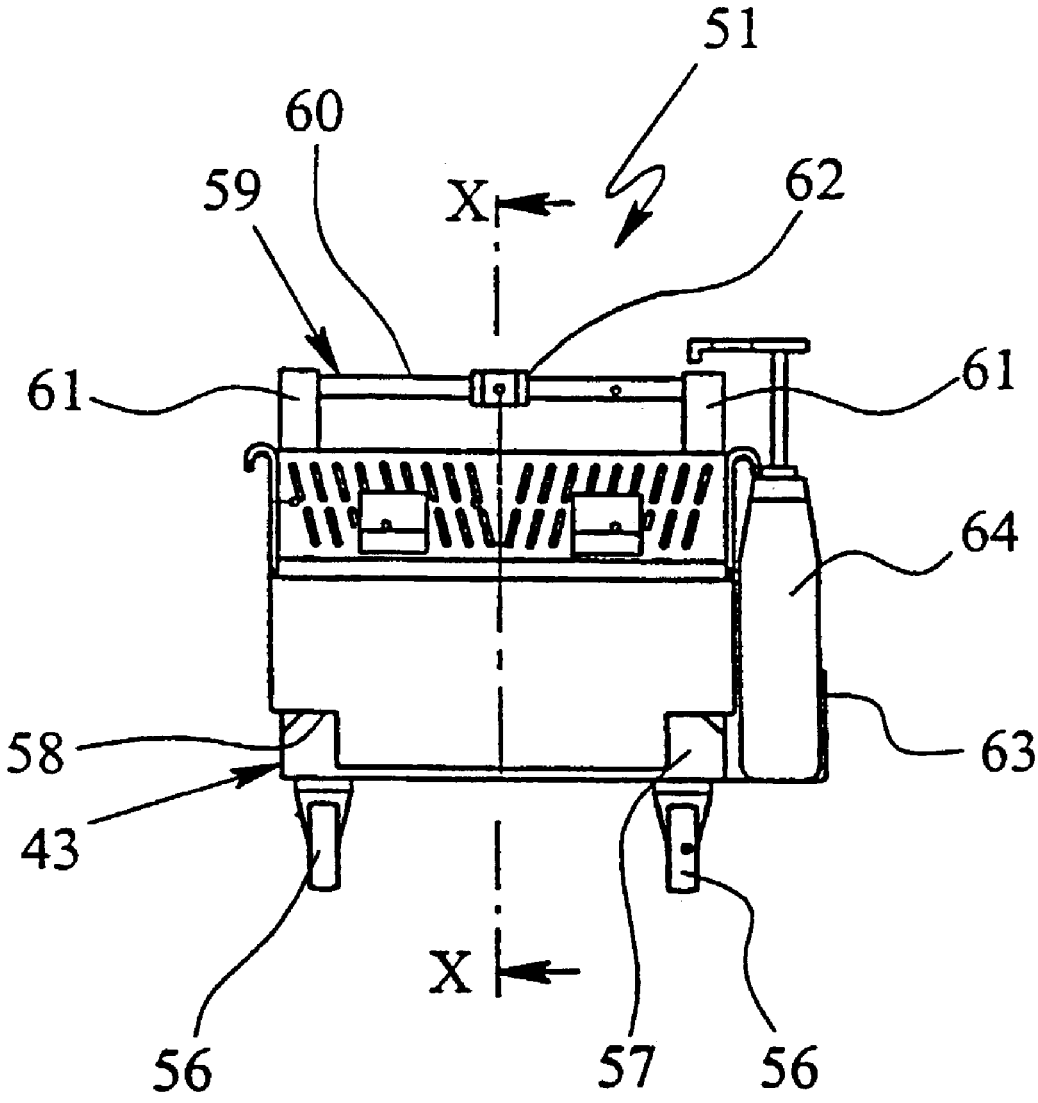
FIG. 8 is a side view of the container device according to FIG. 7 along line VIII—VIII.

FIG. 5 shows that the squeezing-out device 29 comprises fastening means 41 for, in particular, detachable, preferably interlocking fastening on an associated container 42, as indicated in the schematic sectional view in FIG. 8. Alternatively or additionally, the fastening means 41 can also be used for fastening the squeezing-out device 29 on an associated chassis or running gear 43.

In the embodiment illustrated, the fastening means 41 are arranged on both narrow sides of the squeezing-out device 29 and, in this case, have, for example, two U-shaped or hook-shaped holding elements 44 and 45 on each side, as shown, in particular, in FIGS. 5, 6*a*, 7 and 9.

Figure 9:
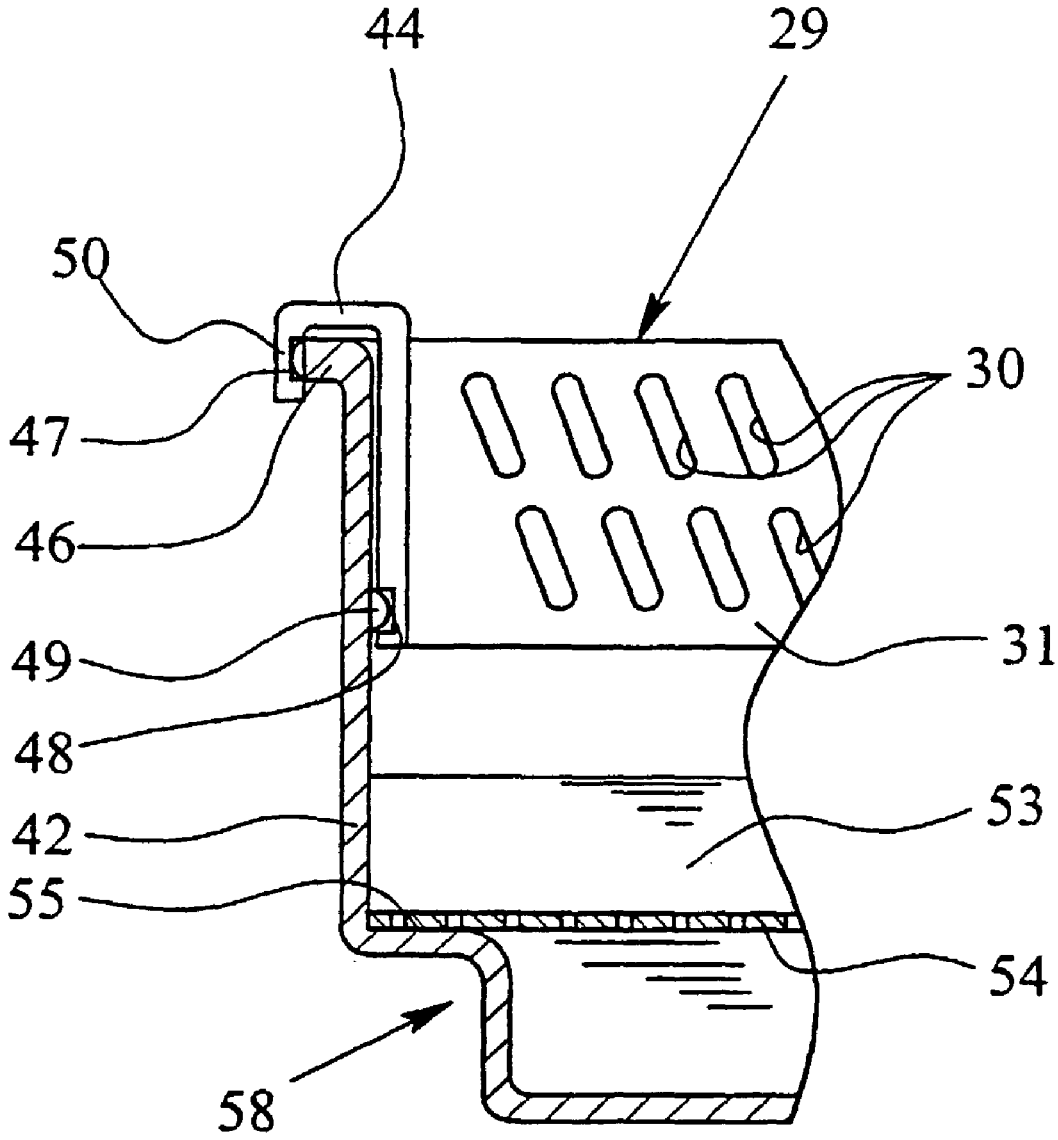
FIG. 9 is an enlarged detail from FIG. 8 illustrating the fastening of the squeezing-out device on a container.

FIG. 9 is a section through a detail of the squeezing-out device 29 attached to the container 42. The fastening means 41 and the holding elements 44, 45 overlap an edge 46 of the container 42, in other words the squeezing-out device 29 is suspended in the container 42 from above. For securing the squeezing-out device 29 on the container 42 in the preferably provided interlocking manner, the fastening means 41 in the example illustrated comprise grooves 47 and 48 in which spring elements (not shown) arranged on the container 42 and/or projections 49 of the container 42 engage. In particular, the grooves 47, 48 are constructed so as to extend horizontally or parallel to the edge 46 in the service position of the squeezing-out device 29, so the squeezing-out device 29 can be placed onto the container 24 from above and can be attached in an interlocking, jamming and/or latching manner to the container 42 by displacement along the edge 46 by the spring elements, projections 49, the edge 46 engaging with its free end in the associated groove 47 or other connecting means. For example, the free arm 50 of the holding elements 44, 45 can again be angled inwardly toward the lateral container wall for this purpose in order to be able to pass below the edge 46 which preferably projects laterally.

An essential feature is that the squeezing-out device 29 is attached non-rotatably to the container 42 and/or to the chassis or running gear 43 in such a way that the squeezing-out device 29 can withstand the stresses and torques occurring during the squeezing-out process.

Figure 7:
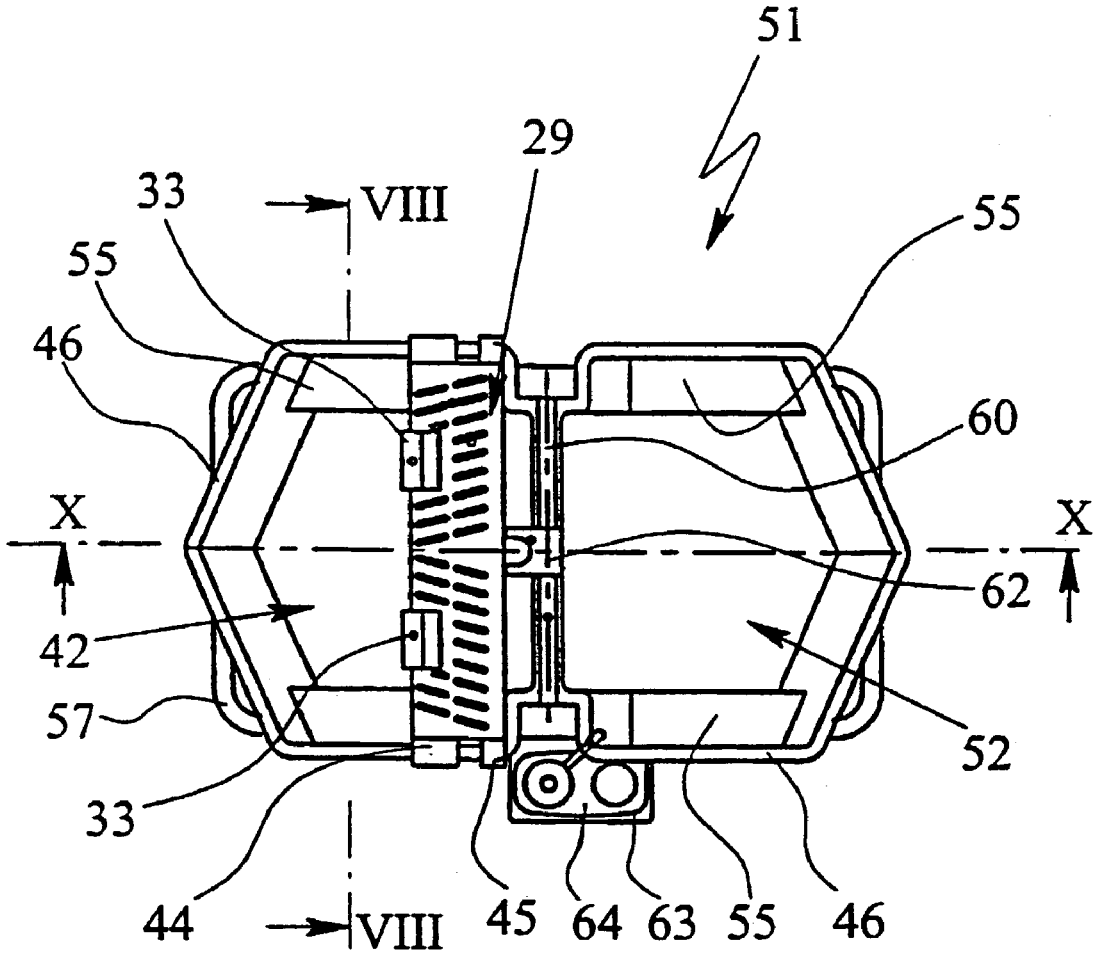
FIG. 7 is a plan view of a proposed container device with the squeezing-out device.

FIGS. 7 and 8 show a proposed container device 51 which the squeezing-out device 29, the container 42, the chassis and running gear 43 and a further container 52 which is preferably identical to the container 42, comprises. The further container 52 is preferably used to receive a cleaning liquor, not shown, a cleaning fluid, water or the like. The container 42 associated with and carrying the squeezing-out device 29 takes up, in particular, soiled cleaning fluid 53 which has been squeezed out of the wiping textile 5 by means of the squeezing-out device 29 and is collected in the container 42.

The containers 42, 52 and/or the squeezing-out device 29 are preferably produced from plastics material.

The schematic partial section according to FIG. 9 shows that the containers 42, 52 are preferably provided with a disc or perforated plate 54 arranged at a distance from the respective container base, for example at a height of about 5 cm. This loosely inserted disc or perforated plate 54 is preferably laid on internally projecting appendages or shoulders 55 of the containers 42, 52. Coarse dirt may accumulate below the disc or perforated plate 54, and the disc or perforated plate 54 reduces at least the swirling of this coarse dirt during a movement of the liquid located in the container 42, 52, in particular due to flushing movements of the immersed wiping panel 4.

The containers 42 and 52 are arranged relative to one another such that the adjacent portions of their edges 46 at least abut and preferably even overlap to prevent cleaning fluid from dripping from one container to another container and onto the floor when exchanged with the wiping panel 4.

The running gear 43 has castors 56 which allow easy travel of the container device 51. However, the castors 56 are not absolutely essential, for example the container device 51 may be constructed so as to be only portable. In this case, the container device 51 does not have running gear 43 but merely a portable chassis 43.

The chassis or running gear 43 has a profile frame 57 which is indicated schematically in FIGS. 7 and 8 and on or in which the containers 42, 52 may be deposited. The containers 42, 52 are held at least in a slip free manner by the profile frame 57, in particular in that the profile frame 57 engages in correspondingly adapted, external indentations 58—corresponding to the shoulders 55 here—of the containers 42, 52. If necessary, however, the containers 42, 52 may additionally be connected to the profile frame 47 and/or generally to the chassis or running gear 43 in another manner. In this case, the containers 42, 52 may be releasably attached to the chassis or running gear 43, in particular by connecting means (not shown), for example in a jamming, latching and/or interlocking manner.

The running gear 43 has a hand grip 59 which is constructed, in particular, as a carrying grip, is hoop-like here and is formed by a cross member 60 attached to the profile frame 57 by lateral spars 61. The container device 51 can be carried by means of the hand grip 59.

The running gear 43 and the handle 59, in particular the cross member 60, is provided with a handle mount 62 to which the handle 2 of the wiping device 1 may be releasably attached so the handle 2, when attached to the handle mount 62, forms a shaft for the container device 51. In the example illustrated, it is proposed for the counter-support of the handle 2 that the wiping panel 4 be inserted into the squeezing-out device 29. The handle mount 62 is accordingly arranged in the vicinity of the squeezing-out device 29. The handle mount 62 is constructed in such a way that the handle 2 can be fixed by jamming. For this purpose, the handle mount 62 is designed, for example, in the manner of a clip.

In this case, the running gear 43 is additionally provided with a mount 63 for receiving a, for example, bottle-shaped detergent container 64 or the like.

Figure 10:
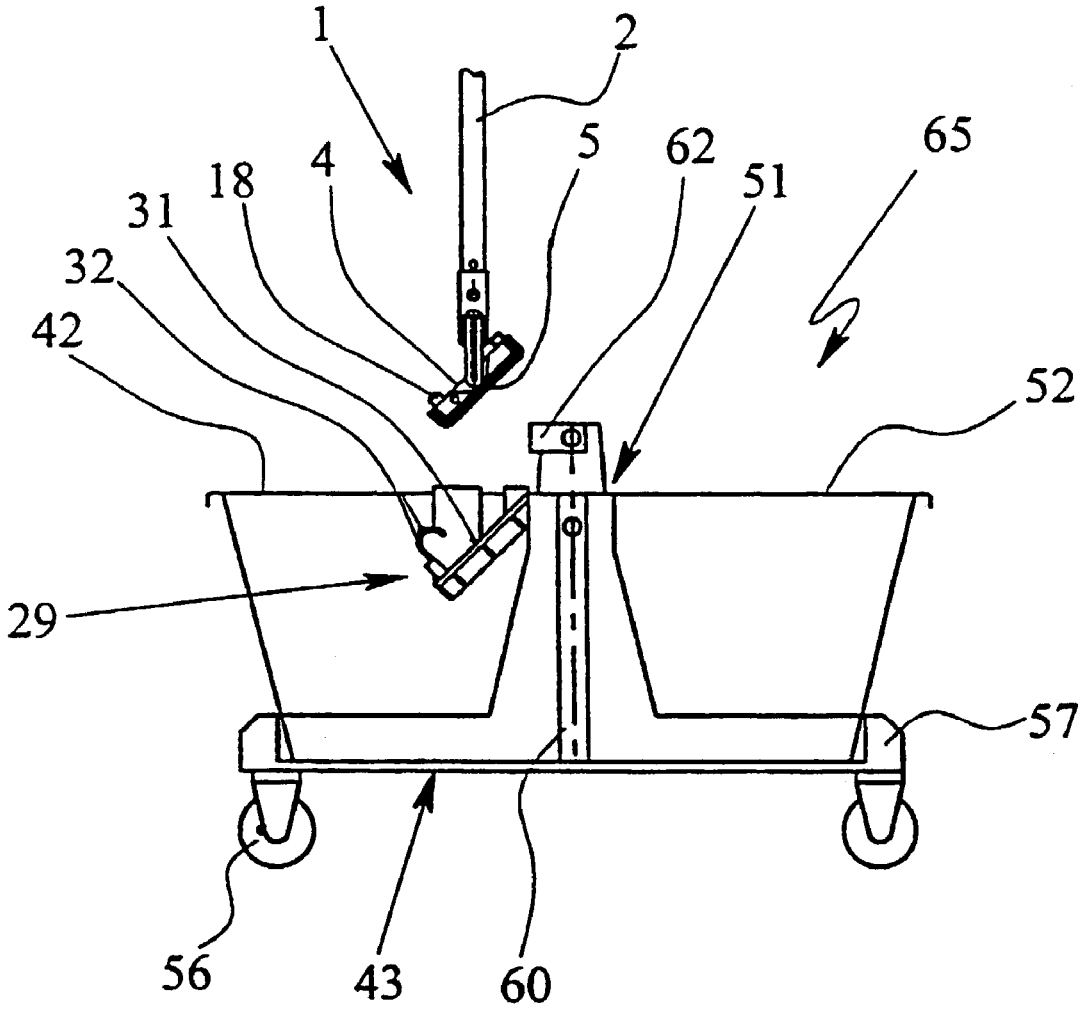
FIG. 10 is a proposed wiping system with a container device according to FIGS. 7 and 8 in a schematic sectional view along line X—X and with the wiping device just before insertion of the wiping panel into the squeezing-out device.

FIG. 10 shows a proposed wiping system 65 formed from the container device 51 and the wiping device 1.

A second and third preferred embodiment of the wiping device 1 and its wiping panel 4 and of the squeezing-out device 29 and its counter-support device 32 are described in more detail hereinafter with reference to FIGS. 11 and 12. The same reference numerals as in the first embodiment are used for identical or similar parts, repetition of the description being omitted for the sake of clarity and only significant differences from the embodiment already described with reference to FIGS. 1 to 10 being described. In particular, combinations of individual features of the various embodiments are possible.

Figure 11:
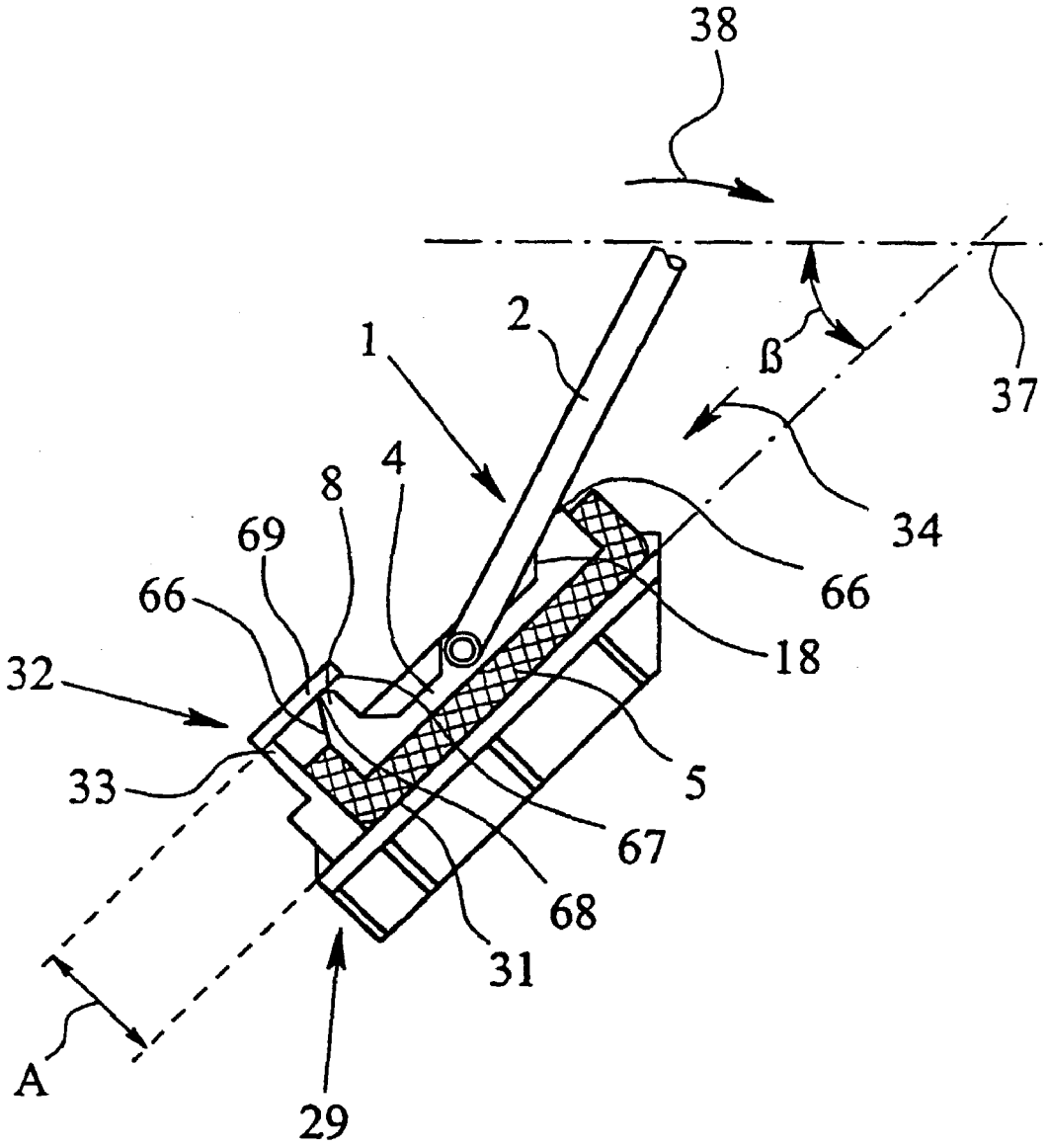
FIG. 11 is a proposed squeezing-out device with inserted wiping panel of a proposed wiping device according to a second embodiment in an illustration corresponding to FIG. 6*b*.

In the second embodiment according to FIG. 11, the holding portions 8 of the wiping panel 4 have an external insertion ramp 66 or other bevels or rounded regions. In particular, the holding portions 8 may be at least substantially trapezoidal or bead-like in cross-section. This simplifies insertion of the wiping panel 4 with the wiping textile 5 between the support face 31 and the counter-support device 32, in particular when the wiping panel 4 is fixable or held therebetween at least in a slightly jammed manner—in particular owing to the elastic deformability of the wiping textile 5.

The counter-support device 32 and the counter-support elements 33 thereof is or are constructed in the second embodiment so as to form a counter-support face 67 which is spaced from the support face 31 and, by cooperation, in particular with an upper side 68 of the inserted holding portions 8, allows the wiping panel 4 to be held down and abutted when the wiping textile 5 is squeezed out. In particular, the counter-support face 67 extends at least substantially parallel or at a slight inclination to the support face 31, in particular so as to form an undercut with respect to the insertion movement 34 which is substantially linear in this case. In particular, the counter-support elements 33 have an at least substantially L-shaped construction here and comprise an arm 69 which extends at least substantially parallel to the support face 31 and forms the counter-support face 68.

Figure 12:
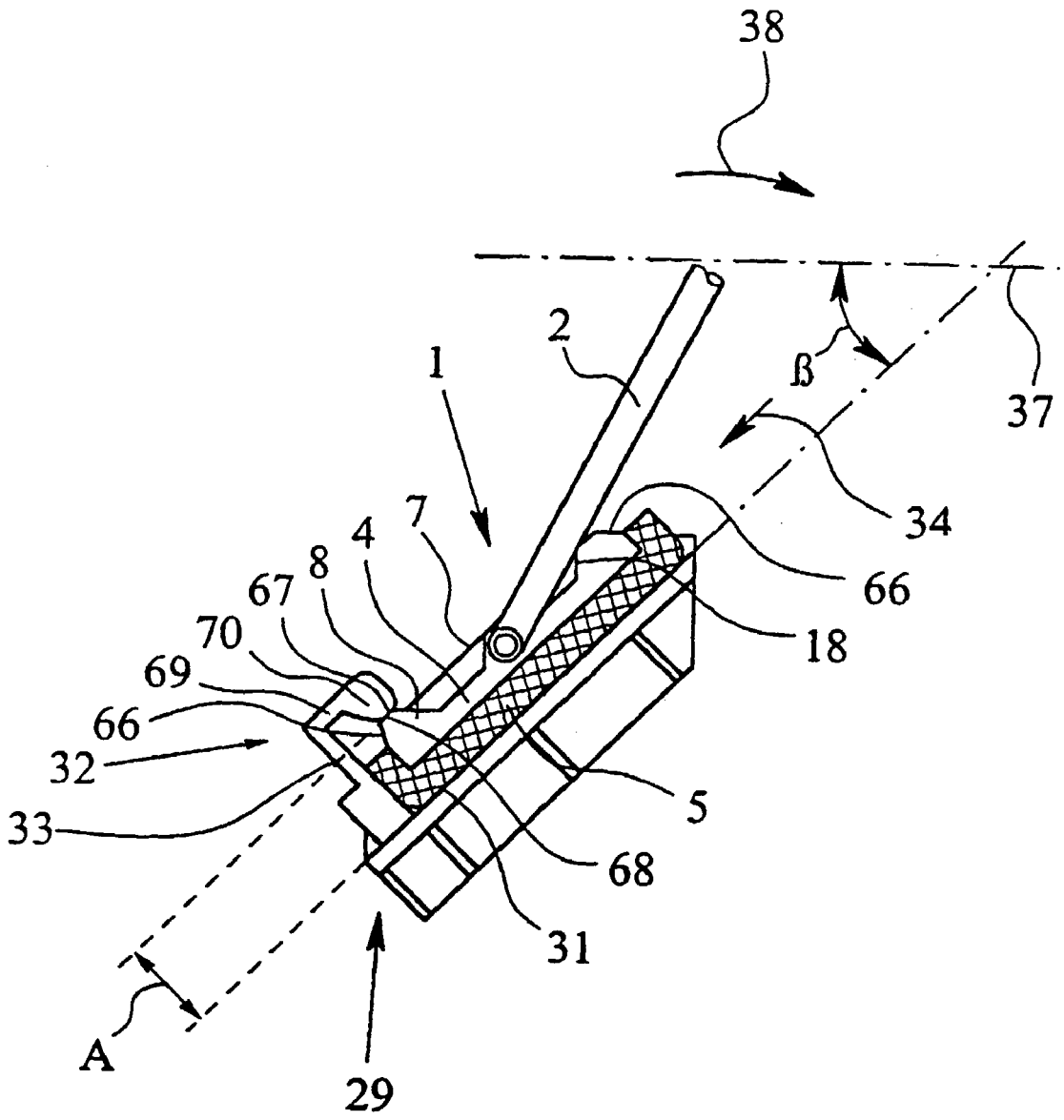
FIG. 12 is a proposed squeezing-out device with inserted wiping panel of a proposed wiping device according to a third embodiment in an illustration corresponding to FIG. 6*b*.

The third embodiment according to FIG. 12 differs from the second embodiment in that the holding portions 8 unfold and, instead, the external sides of the longitudinal edges 12 of the wiping panel 4 and/or of the outer marginal reinforcing ribs 14 are bevelled or rounded—at least in the longitudinal portions corresponding to the counter-support elements 33, insertion ramps 66, in particular, again being formed.

In particular, the marginal reinforcing ribs 14 may be at least substantially trapezoidal or bead-like in cross-section.

The counter-support device 32 may be constructed, for example, with a correspondingly reduced clearance A between the counter-support face 67 and the support face 31, as in the second embodiment according to FIG. 11 or may be modified, for example, according to the third embodiment shown in FIG. 12, in particular may be provided with a projection 70 or the like forming the counter-support face 67.

In the second or third embodiment, the insertion ramp 66 simplifies insertion of the wiping panel 4 into the squeezing-out device 29. Handling of the wiping device 1 is accordingly simplified.

The counter-support face 67 extending at least substantially parallel to the support face 31 prevents—in particular in cooperation with the washing textile 5 engaging at least partially into the perforations 30 in the support face 31—unintentional movement or slipping of the wiping panel 4 from the squeezing-out device 29 when the wiping textile 5 is squeezed out.

The invention claimed is:

1. A wiping system comprising:

a wiping device, at least one container for receiving liquid, and a squeezing-out device for the wiping device and coupled with the container, wherein the wiping device has a handle and a wiping panel, the wiping panel having a substantially planer underside, an upper side, a longitudinal axis, a longitudinal edge extending parallel to the longitudinal axis, and at least one holding portion, wherein the wiping panel is attached to the handle by a universal joint and is substantially rigid, the wiping panel being configured to hold a flat wiping element on the underside of the wiping panel, and the wiping panel defining a stop for the handle, the stop being on the upper side of the wiping panel and remote the holding portion, and the at least one holding portion projects from the wiping panel upper side remote from the wiping panel underside and is adjacent to the longitudinal edge of the wiping panel, and wherein the squeezing-out device has a support face provided with perforations and a counter-support device spaced a distance from the support face such tat the wiping panel of the wiping device can be introduced between the support face and the counter-support device with a downwardly directed insertion movement and can be pressed against the support face, the counter-support device being configured to engage the holding portion of the wiping device and having a counter-support face, the counter-support face being a distance from the support face, the distance corresponding substantially to the insertion thickness of the wiping panel and the wiping element.

2. The wiping system of claim 1, wherein the counter-support device comprises a counter-support arm extending substantially parallel to the support face and forming the counter-support face.

3. The wiping system of claim 1, wherein the counter-support device comprises at least two counter-support elements and are arranged along a longitudinal edge of the support face.

4. The wiping system of claim 1, wherein the support face is inclined to the horizontal by 30° to 60° in the service position.

5. The wiping system of claim 1, wherein a region of the support face remote from the counter-support device and the counter-support device are movable relative to one another when the underside of the wiping panel is pressed against the support face.

6. The wiping system of claim 1, wherein the support face is tiltably mounted.

7. The wiping system of claim 1, wherein that the squeezing-out device comprises a fastening element for detachably fastening the squeezing-out device to the container.

8. The wiping system of claim 7, wherein the fastening element comprises grooves to engage with spring elements of the container.

9. The wiping system of claim 7, wherein the fastening element comprises a substantially U-shaped holding element for cooperation with an edge of the container.

10. The wiping system of claim 1, wherein the wiping system further comprises a chassis.

11. The wiping system of claim 1, wherein the container has a base and comprises a disc or perforated plate arranged at a distance from the container base.

12. A wiping system comprising:

a wiping device, at least one container for receiving liquid, a squeezing-out device for the wiping device and coupled with the container, and a chassis, wherein the wiping device has a handle and a wiping panel, the wiping panel having a substantial ally planer underside, an upper side, a longitudinal axis, a longitudinal edge extending parallel to the longitudinal axis, and at least one holding portion, wherein the wiping panel is attached to the handle by a universal joint and is substantially rigid, the wiping panel being configured to hold a flat wiping element on the underside of the wiping panel, and the wiping panel defining a stop for the handle, the stop being on the upper side of the wiping panel and remote the holding portion, and the at least one holding portion projects from the wiping panel upper side remote the wiping panel underside and is adjacent to the longitudinal edge of the wiping panel, and wherein the squeezing-out device has a support face provided with perforations and a counter-support device spaced a distance from the support face such that the wiping panel of the wiping device can be introduced between the support face and the counter-support device with a downwardly directed insertion movement and can be pressed against the support face, the counter-support device being configured to engage the holding portion of the wiping device and having a counter-support face, the counter-support face being a distance from the support face, the distance corresponding substantially to the insertion thickness of the wiping panel and the wiping element.

13. The wiping system of claim 12, wherein the squeezing-out device is attached to the container or the chassis.

14. The wiping system of claim 12, wherein the squeezing-out device is interlockingly attachable to the container.

15. The wiping system of claim 12, wherein the container is releasably attachable to the chassis.

16. The wiping system of claim 12, wherein the chassis comprises a handle mount for fixedly attaching the handle of the wiping device during transport.

* * * * *